United States Patent [19]

McMellon

[11] Patent Number: 4,736,787

[45] Date of Patent: Apr. 12, 1988

[54] LOST FOAM HANDLING SYSTEM

[75] Inventor: Bruce A. McMellon, Birmingham, Ala.

[73] Assignee: Vulcan Engineering Co., Helena, Ala.

[21] Appl. No.: 67,486

[22] Filed: Jun. 29, 1987

[51] Int. Cl.[4] ..... B22D 33/00

[52] U.S. Cl. ..... 164/154; 164/324; 164/339; 198/793; 198/845

[58] Field of Search ..... 164/322, 323, 324, 325, 164/326, 34, 130, 339, 150, 154; 198/793, 795, 800, 838, 845

[56] References Cited

U.S. PATENT DOCUMENTS

| | | | |
|---|---|---|---|
| 2,347,346 | 4/1944 | Wright | 164/150 |
| 3,565,239 | 2/1971 | Walker et al. | 198/845 |
| 4,299,269 | 11/1981 | Friesen et al. | 164/324 |
| 4,402,393 | 9/1983 | Kent | 198/803.01 |

*Primary Examiner*—Nicholas P. Godici
*Assistant Examiner*—Richard K. Seidel
*Attorney, Agent, or Firm*—Jennings, Carter, Thompson & Veal

[57] ABSTRACT

A conveyor system for use in a lost foam casting system connects a plurality of stations where operations necessary to the process are carried out. The system utilizes an interconnected train of open frame gondolas supported on a set of elevated parallel horizontal rails forming a closed loop. The gondolas each support a flask wherein molds are placed and sand molds are compacted, with the flasks being removable from the gondolas as necessary for the particular operation. A programmable controller senses the status of the system and provides signals to operate the conveyor and associated components.

19 Claims, 5 Drawing Sheets

FIG. 3
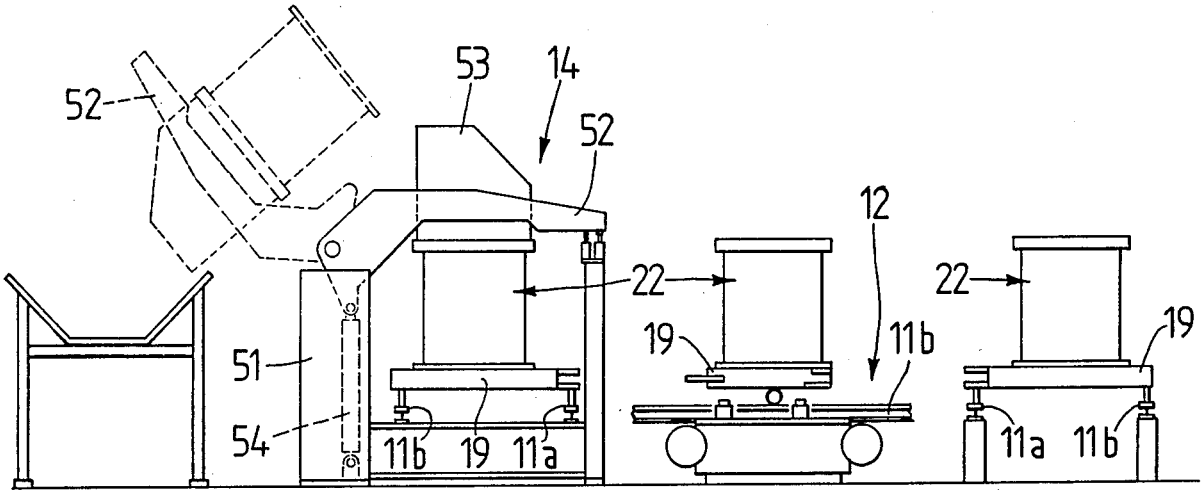
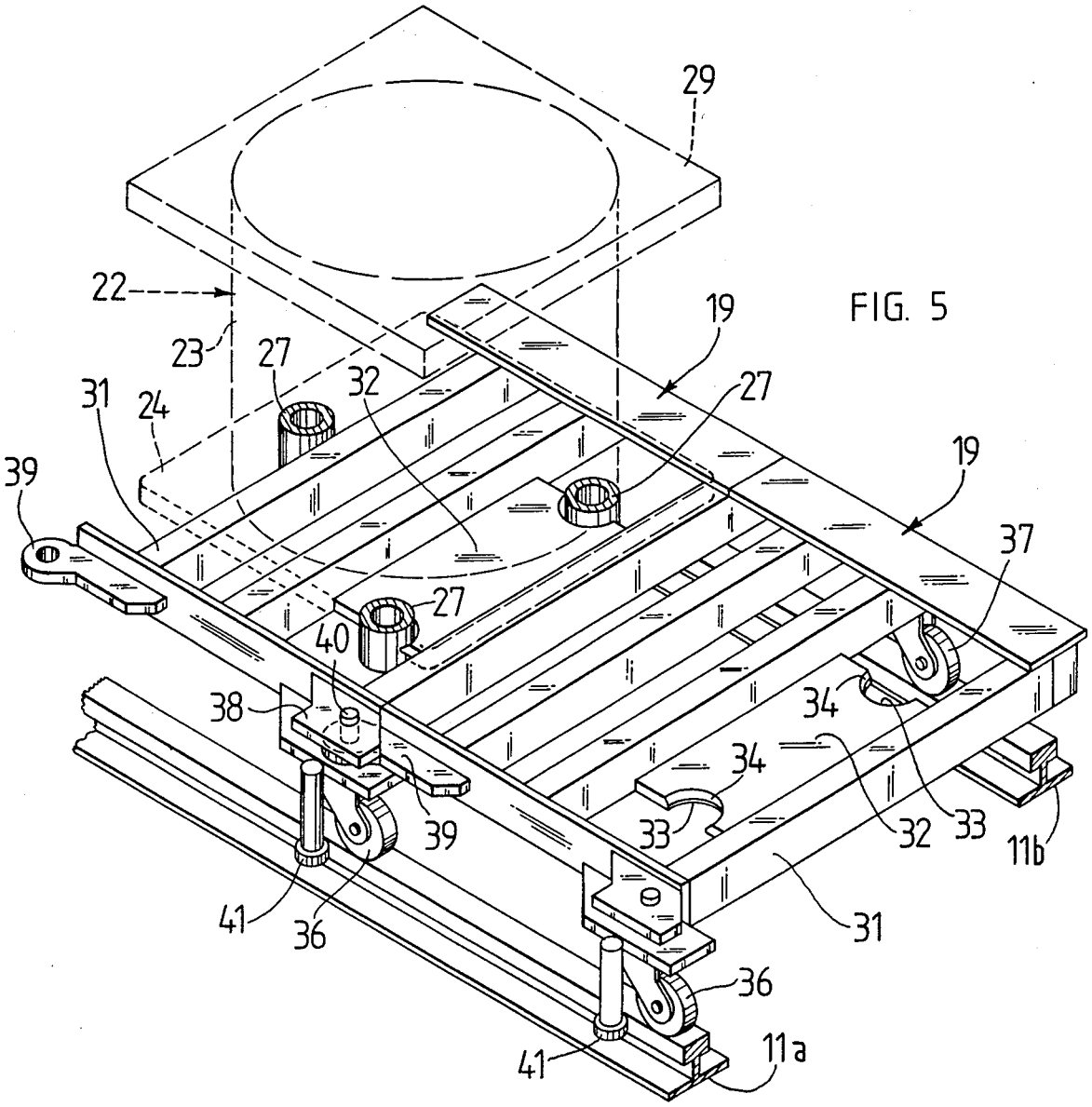
FIG. 5

LOST FOAM HANDLING SYSTEM

FIELD OF THE INVENTION

The present invention relates to foundry equipment and more particularly to foundry equipment utilized in practicing lost foam casting in sand molds. Even more particularly, the present invention relates to an automated conveyance system for practicing the lost foam casting process. In even greater particularity, the present invention may be described as a continuous loop lost foam casting system wherein mold forming, pouring, and removal of the casting are automatically accomplished in a continuous sequence.

BACKGROUND OF THE INVENTION

The lost foam or evaporative foam process involves the placement of a foam model or pattern, usually expanded polystyrene or "styrofoam", in a container or flask, then surrounding it with dry unbonded sand which is compacted to form a mold. Molten metal is then poured into the mold thereby vaporizing the foam and filling the resulting void. The metal solidifies to form a casting of this same shape which is then removed from the flask.

SUMMARY OF THE INVENTION

It is the object of this invention to provide an automated system to advantageously utilize the lost foam process.

Another object of the invention is to provide an automated system which is simple in structure and operation and which requires minimal maintenance.

Another object of the invention is to provide an automated system which provides gentle movement of the molds between dwell points where foundry operations are conducted, thereby reducing wear and tear on the system components and maintaining the integrity of the molds.

Yet another object of the invention is to provide a lost foam casting system which is flexible and adaptable to various parameters such that the basic system may be used in a number of foundry operations.

These and other objects and advantages of my system are accomplished through theuse of a curvilinear loop of parallel rails upon which a continuous train of carriers or gondolas is supported by casters and guide wheels. Each gondola is pivotally connected to the adjacent gondolas proximal the inner rail such that the gondolas may negotiate curves in the loop.

Each gondola supports a flask and positions the flask for manipulation at various stations in the system. In as much as the flasks are not attached to the gondolas, they may be lifted or removed from the gondolas at various stations along the track for operations to be performed. Some typical operations are inserting foam models, filling flasks with sand, compacting sand, applying vacuum, pouring metal, exhausting fumes, adding new sand, extracting castings, and dumping sand. Cooling time for the castings is conrolled by the combination of the speed of the train of gondolas about the system and the number of gondolas. Motion of the line is accomplished by a driver system which indexes the train of gondolas and then holds them stationary for a dwell period while operations are performed.

BRIEF DESCRIPTION OF THE DRAWINGS

Apparatus embodying features of my invention are depicted in the accompanying drawings which form a portion of this application and wherein:

FIG. 3 is a sectional view taken along line 3—3 of FIG. 2;

FIG. 5 is a perspective view of the gondola showing an exemplary flask alignment construction;

DESCRIPTION OF A PREFERRED EMBODIMENT

My improvement and innovations are essentially in the structures utilized to automate the lost foam process, thus it will be understood that certain componetns depicted and discussed herein are conventional foundry components which may be replaced by equivalent structures for performing the same operation without departing from the scope of my invention.

Figure 1:
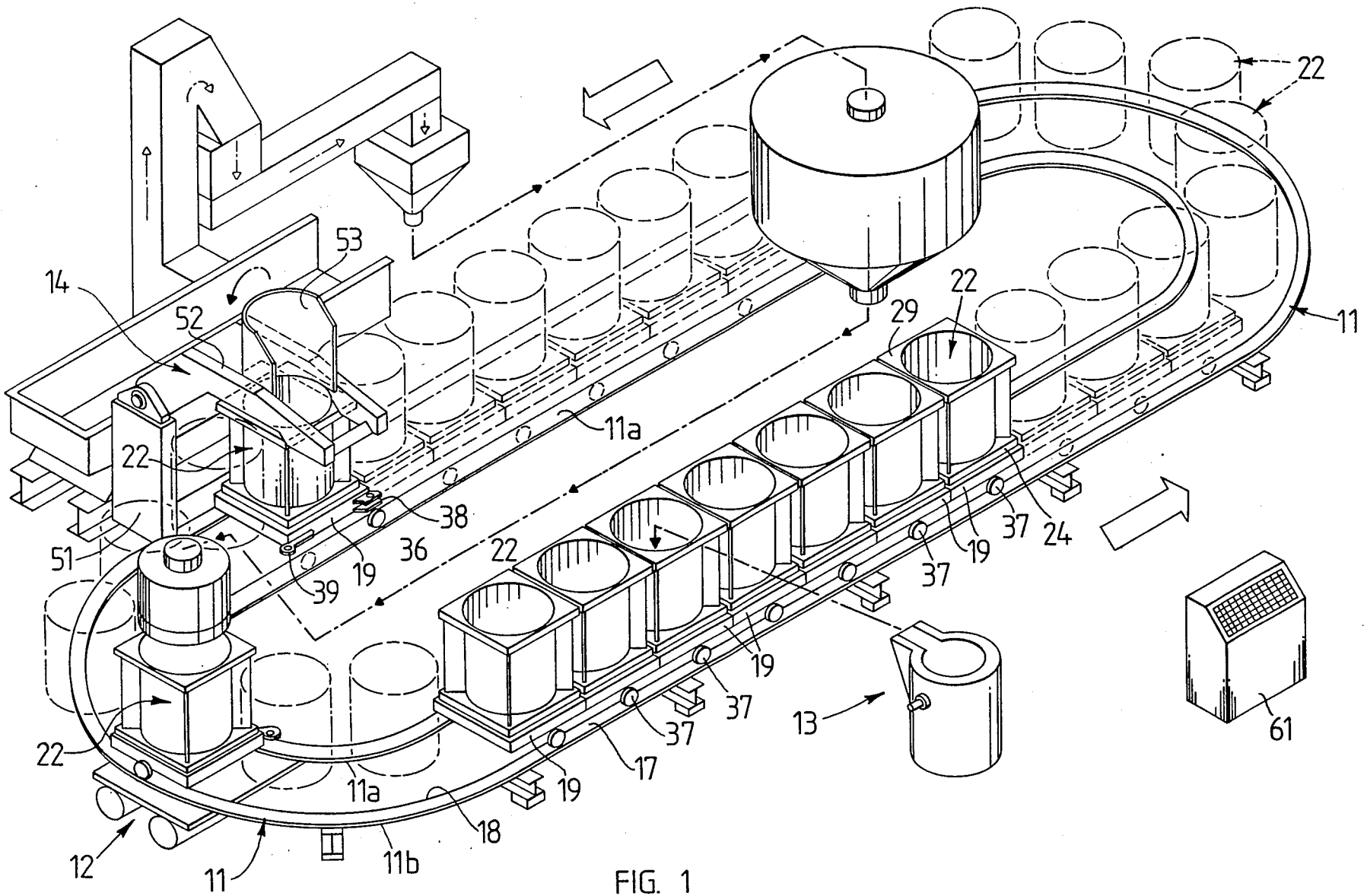
FIG. 1 is a perspective view of a system embodying apparatus showing various stations at which operations are performed.
Figure 2:
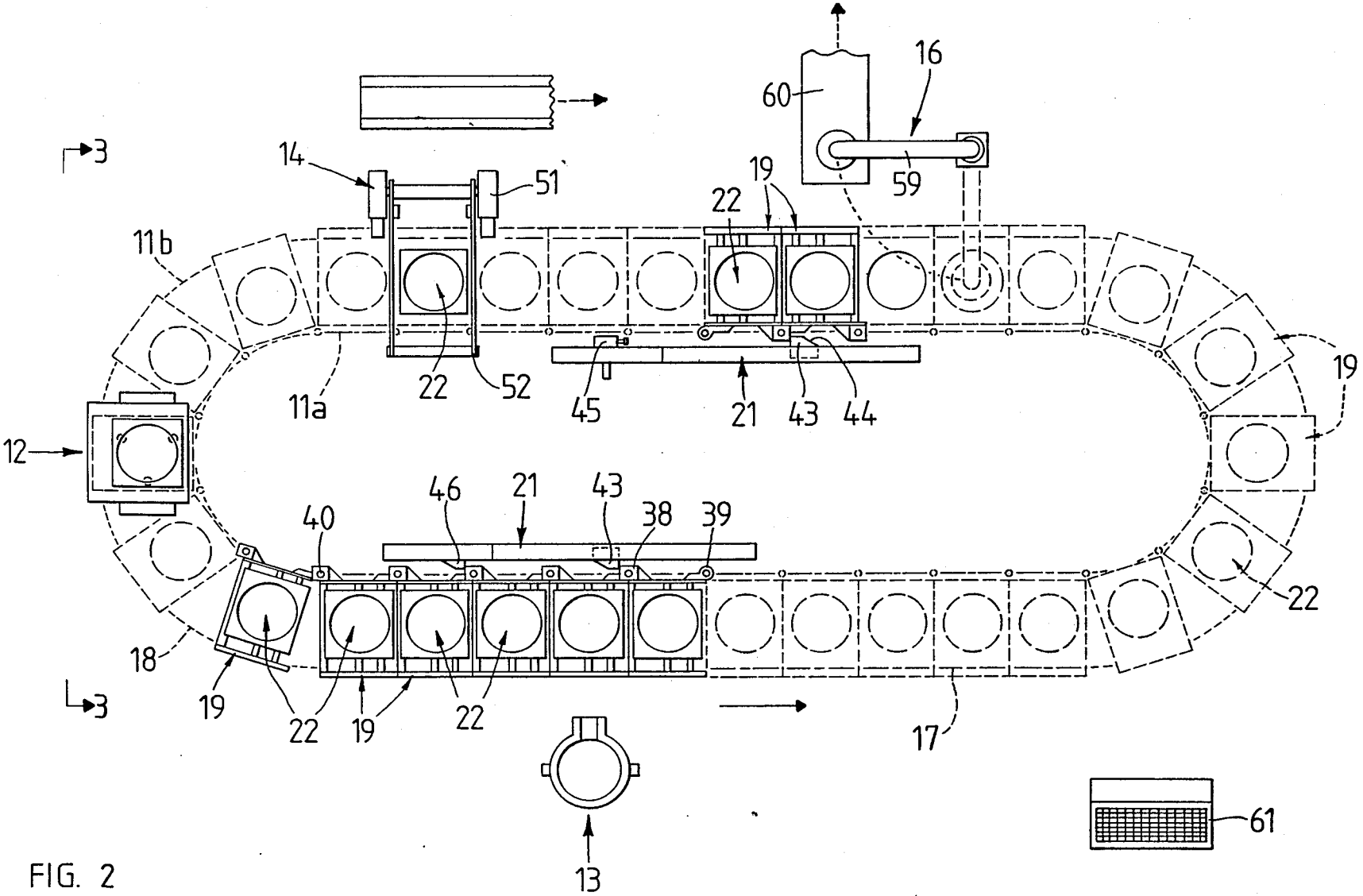
FIG. 2 is a plan view of a system similar to FIG. 1.

Referring to FIGS. 1 and 2, it will be seen that the system utilizes a closed curvilinear set of rails 11 to connect a plurality of stations whereat the lost foam processing operations are carried out. The stations may include a compaction station 12 which may also serve as a foam insertion station depending on the compaction unit selected, a pouring station 13 where one or more automated or manually controlled pouring units pour molten metal into the mold; a dump station 14 where the mold is emptied. Additional stations, such as a robotic casting removal station 16 may also be provided dependent upon the wishes of the foundry and the specific handling requirements of the casting being done. The track 11 is a pair of rails 11*a* and 11*b* which are configured as may be convenient depending upon the space available and the cooling requirements of the metals used. In the embodiments shown herein, the track 11 is oval shaped including a linear section 17 which may be added to or substracted from and fixed sections 18 which have a predetermined radius of curvature. Preferentially, the track 11 is elevated to provide easy access to the components for maintenance and to simplify and economize construction of the system.

The rails 11*a* and 11*b* support a plurality of carriages or gondolas 19 which are interconnected to form a continuous train about the track 11. The gondolas 19 are moved by a driver mechanism 21 which provides for indexed movement and positions the gondolas 19 for appropriate dwell times at each operation station.

Figure 4:
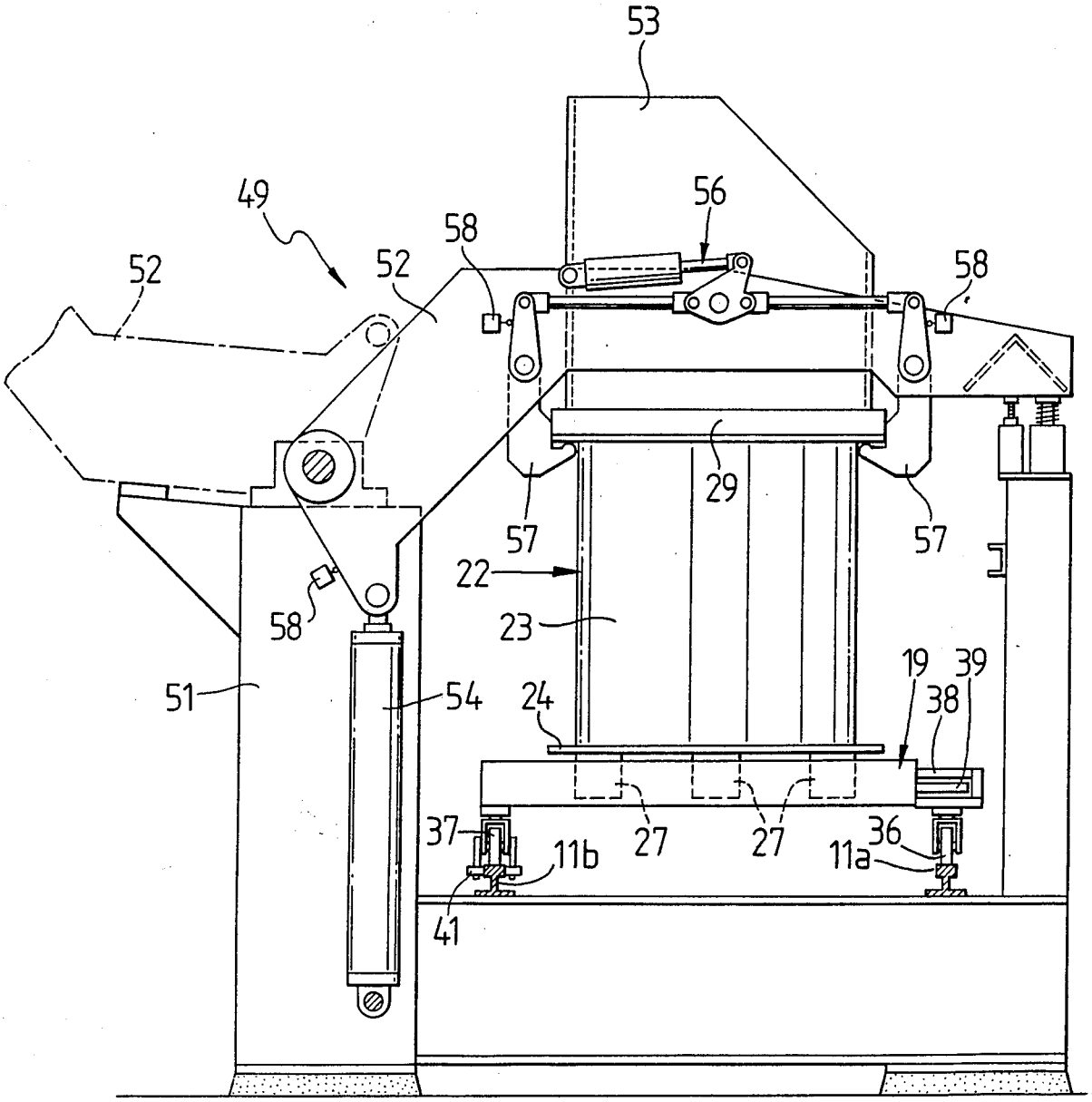
FIG. 4 is a sectional view taken along line 4—4 of FIG. 2.

Each gondola 19 carries a flask 22 which is essentially a hollow structural member wherein a foam model is received and wherein sand is compacted to form a casting mold. The specific configuration of the flask 22 will be dependent on the type of equipment utilized in the various operating stations. For example, the equipment available for use in the compaction station 12 is available from a variety of vendors and each type engages the flask 22 in a different manner. Therefore, a specific flask configuration will be discussed herein as an example of a flask 22 having features which allow it to be used in the present system. With reference to FIG. 4, it will be seen that the flask 22 is a hollow upright container having a body portion 23, a base 24, and alignment means 26 which in this embodiment utilize three support posts 27 depending from the base 24 and recessed on the lower end thereof as at 28 to receive mating supports a compaction station 12 shown in FIG. 3. The flask 22 also includes a flange 29 at the top thereof which is sturdy enough to allow the flask and its contents to be lifted thereby.

The gondola 19 is adapted to receive the flask 22 cooperatively with the alignment means 26 such that the flask 22 is properly positioned relative to the compaction station 12 and the dump station 14 to permit proper operation thereof. In the embodiment shown, the gondola 19 is essentially an open frame 31 supporting an alignment plate 32 having opposed cut away portions 33 as shown in FIG. 5. The cutout portions have beveled edges 34 and are spaced apart such that the alignment plate 32 will fit between two of the support posts only if the flask 22 is properly aligned on the gondola 19. The base 24 rests on the frame 31 and the posts 27 extend through the frame for engagement in the compaction station 12. The open frame gondola 19 is amenable to use with other compaction equipment in that it allows the flask 22 to be lifted from the frame 31 for manipulation by the compaction equipment. In this manner, neither the gondola 19 nor the track 11 is stressed by the forces required for compaction.

The gondola 19 is supported by an inner and outer swivel caster 36 and 37 respectively. The inner caster 36 is located beneath the inner rear corner of the gondola 19, with respect to the direction of travel, and is attached to an inwardly and rearwardly extending clevis-like member 38 is formed on the gondola. The clevis-like member 38 is formed to cooperate with an inwardly and forwardly extending tongue-like member 39 which is formed on the inner forward corner of the gondola 19 such that the clevis-like member 38 of each gondola 19 receives therein the tongue-like member of the following gondola. An interlocking pin 40 pivotally connects the members 38 and 39 to secure each gondola 19 to the adjacent gondolas. It will be noted that with this arrangement each gondola 19 is supported on the inner rail 11*a* on both the caster 36 affixed to its own clevis-like member 38 and the caster 36 affixed to the leading gondola. The outer casters 37 of each gondola 19 supports the individual gondola on the outer rail 11*b* and is positioned at the mid-point of the frame 31. The inner caster 36 is provided with a set of guide rollers 41 which keep the caster-like members centered on the inner rail 11a.

Figure 6:
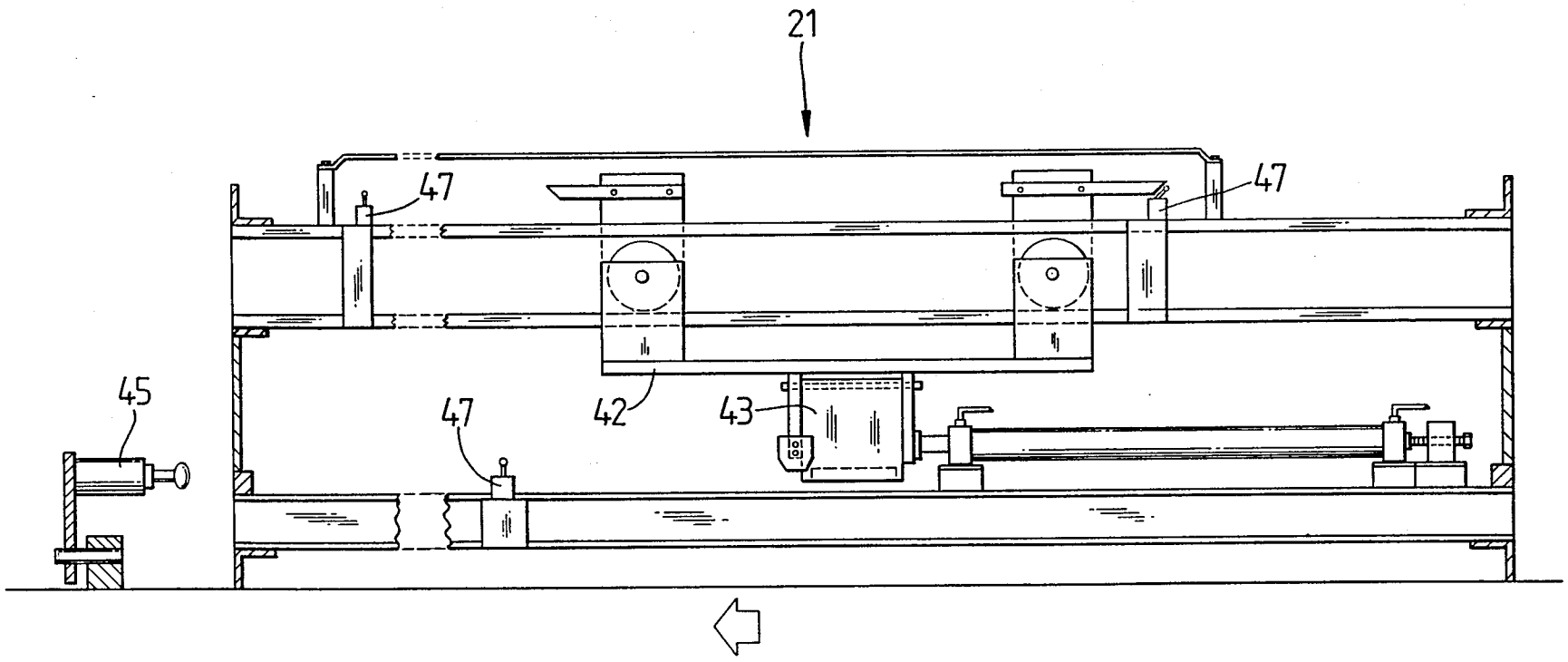
FIG. 6 is a side elevation of one of the drivers illustrating locations of various control sensors.

The clevis-like member 38 of the gondolas 19 serve as more than mere connections between the gondolas. They are also the point at which force is applied by the driver 21 to move the train of gondolas 19 about the track 11. The driver 21 is shown in FIG. 6 as a hydraulically driven carriage 42 which moves parallel to the linear track section as shown in FIG. 2. It will be appreciated that other embodiments such as a geneva movement may be employed. In the illustrated embodiment, the carriage includes a latch member 43 which is pivotally mounted and biased for movement about a horizontal axis parallel to the track 11 and has the rear portion 44 thereof beveled. As the latch 43 is retracted, the beveled rear portion engages the clovis-like member 38 of the next gondola 39 and acts like a cam surface to pivot the latch 43 outwardly as the carriage 42 returns to its initial position. A shock absorbing stop 45 is provided forwardly of the driver to ensure that the train stops at the proper position by engaging the gondola 19 at the end of one increment of travel. This stop is pivotally mounted to be moved out of the way of the gondola's clevis-like member 38 during the first part of each driver stroke. A rebound latch 46 is mounted rearwardly of the driver 21 to prevent the train of gondolas from backlashing when it encounters stop 45. The rebound latch has the same construction as the latch 43 but is not movable on a carriage. A plurality of limit switches 47 are mounted on the driver 21 and the stop 45 to generate signals indicative of the carriage position and the stop position, as well as the speed of the carriage 42.

With reference to FIGS. 1 and 2, it will be noted that a molten metal pouring station 13 is provided. As with the compaction station 12 and driver 21, a variety of apparatus may be used as the physical embodiment of this station including either manual or automated pouring equipment. Likewise, the flask 22 may be modified to cooperate with vapor removal apparatus located at this point to prevent the escape of noxious vapors generated during the pouring process.

In as much as the system is a closed loop, the flasks must be emptied of the sand mold and casting at some point during the cycle. A dump assembly 49 is shown in FIG. 4. The dump assembly 49 includes a main frame 51, a lift frame 52, a dump chute 53, a hydraulic cylinder 54 for raising the lift frame 52 which carry a clamping mechanism 56 which engages the flange 29 of the flask 22. The clamping mechanism includes a pair of jaws 57 shaped to engage the flange 29 and impart an upward force component thereto such that the top of the flange 29 and flask 22 is urged in sealing engagement with the bottom of the dump chute 53. A plurality of limit switches 58 are located to sense the position of the clamping mechanism 56 and the lift frame 52.

In some instances, it may be preferable to remove the casting from the flask 22 prior to the dump station 14. In such instances a robotic removal station 16 is employed intermediate the pouring station 13 and the dump station. This removal station essentially is a movable gripper arm 59 which can retrieve the casting from the flask 22 while the flask is in the gondola 19. The arm 59 may be capable of moving pivotally or linearly depending on the space available to position the casting on an auxiliary conveyor 60 for further processing.

The aforementioned limit switches 47 and 58 as well as similar sensors at the compaction station 12, pouring station 13, and removal station 16 all provide signals to a controller 61 which may be a programmable microprocessor. The signals indicate the position or status of the various components to the controller 61 which is programmed to actuate the driver 21, the compaction station 12, the pouring apparatus, the lift cylinder 54 and clamping mechanism 56, and the retrieval arm 59 in a specified sequence and at predetermined intervals. For example, it may be desirable to operate the system such that a train of 30 flasks completes a circuit in one hour, thereby delivering thirty castings to the auxiliary conveyor. The controller would be programmed to initiate the sequence at each station once during each two minute interval. Through the use of a programmable controller 61 and a controllable driver 21, it is possible to operate at such speeds with smooth and gentle inertial transitions as the train is moved.

While the present invention is simple in its individual components, the combination of elements provide a remarkably versatile conveyor system. With reference to FIG. 3, it may be seen that the entire conveyor system is designed to be supported above the floor such that easy access to the equipment is facilitated and installation is simplified. It may be further appreciated that the separate flask and gondola arrangement permits the flask to be removed from the gondola for specific operations and replaced in proper alignment for subsequent operation at various stations, and thus allows the system to be tailored to the specific needs and resources of the foundry wherein it is installed.

While I have shown my invention in one form, it will be obvious to those skilled in the art that it is not so limited but is susceptible of various changes and modifications without departing from the spirit thereof.

What I claim is:

1. In a lost foam casting system, a closed curvilinear track means having a loading and compaction station, a metal pouring station and a mold unloading system; a plurality of flask carrying gondolas supported for movement along the track means with each gondola including means for registering said flask thereon for alignment in said compaction station, and with each of said gondolas being pivotally connected to each adjacent gondola; drive means for effecting intermittent movement of the mold carriers between indexed positions along said track means; and a plurality of mold forming flasks adapted for registry in said gondolas and detachably supported thereon.

2. The structure as defined in claim 1 wherein said track means comprises a pair of horizontally spaced generally parallel rail-like members.

3. The structure as defined in claim 2 wherein each gondola is supported on one of said rail-like members on an inner and outer wheel respectively with the inner wheel of each gondola additionally supporting an adjacent gondola.

4. The structure as defined in claim 1 wherein said flasks include means affixed thereto for engagement with said compaction station such that said flasks may be lifted from said gondola during compression of the mold in said flask.

5. The structure as defined in claim 4 wherein each gondola comprises:

(a) a longitudinal frame;

(b) a plurality of horizontally disposed support members affixed to said frame and spaced apart to support said flask and permit engagement of said engagement means with said compaction station;

(c) guide means for registering said flask on said support members; and (d) track engaging means for supporting said gondola on said track means.

6. The structure as defined in claim 5 wherein said track means comprises a pair of horizontally spaced generally parallel rail-like members.

7. The structure as defined in claim 6 wherein each gondola is supported on one of said rail-like members on an inner and outer wheel respectively with the inner wheel of each gondola additionally supporting an adjacent gondola.

8. The structure as defined in claim 4 wherein said flasks include an upper peripheral member extending outwardly therefrom and adapted for engagement with said mold unloading station for removal from said gondola.

9. The structure as defined in claim 1 wherein the centerline of said track means coincides with the centerline of said loading and compaction station, said pouring station, and said mold unloading station.

10. The structure as defined in claim 9 wherein each gondola has a laterally extending clevis at one interior corner and coupling tongue at a second interior corner with said gondolas being coupled one to another via said tongue and clevis.

11. The structure as defined in claim 1 wherein each gondola comprises:

(a) a longitudinal frame:

(b) a plurality of horizontally disposed support members affixed to said frame and spaced apart to support said flask and permit engagement of said engagement means with said compaction station;

(c) guide means for registering said flask on said gondola; and (d) track engaging means for supporting said gondola on said track means.

12. The structure as defined in claim 1 further comprising a plurality of sensors positioned about said track for detecting the position of said gondolas and the status of said unloading station and said driver means and outputting a signal responsive thereto; and a programmable controller receiving signals from said plurality of sensors and provided with data to control said system components in accordance with said signals and a set of predetermined control parameters.

13. The structure as defined in claim 12 further comprising means for removing a casting from said flask intermediate said pouring station and said mold unloading station.

14. In a lost foam casting system, conveyor means for interconnecting a plurality of operating stations including a mold forming station, a metal pouring station, and a mold removing station, said conveyor including a horizontally disposed curvilinear track forming a closed loop through said operating stations; a plurality of flasks for forming molds therein and receiving molten metal therein in the lost foam process; a plurality of gondolas supported on said track and connected to each other to form a continuous train thereof about said track, each gondola including means for registering one of said flasks in proper cooperative alignment with said operating stations; and means for intermittently urging said train of gondolas about said track to sequentially position said flasks in said operating stations.

15. A system as defined in claim 14 wherein said track comprises a pair of elevated parallel rail members.

16. The system as defined in claim 15 wherein each gondola is supported on one of said rail-like members on an inner and outer wheel respectively with the inner wheel of each gondola additionally supporting an adjacent gondola.

17. The system as defined in claim 16 wherein each gondola has a laterally extending clevis at one interior corner and coupling tongue at a second interior corner with said gondolas being coupled one to another via said tongue and clevis.

18. The system as defined in claim 14 further comprising a plurality of sensors positioned about said track for detecting the position of said gondolas and the status of said unloading station and said driver means and outputting a signal responsive thereto; and a programmable controller receiving signals from said plurality of sensors and provided with data to control said system components in accordance with said signals and a set of predetermined control parameters.

19. The system as defined in claim 14 wherein each flask includes means engagable by said operating station for lifting said flasks from its associated gondola.

* * * * *

UNITED STATES PATENT AND TRADEMARK OFFICE

CERTIFICATE OF CORRECTION

PATENT NO. : 4,736,787

DATED : April 12, 1988

INVENTOR(S) : Bruce A. McMellon

It is certified that error appears in the above-identified patent and that said Letters Patent is hereby corrected as shown below:

Column 3, line 3, delete "26".
Column 3, line 6, insert -from- after "supports".
Claim 11, line 1, change "1" to -8-.
Claim 14, line 4, insert -means- after "conveyor".

Signed and Sealed this

Twenty-seventh Day of April, 1999

*Attest:*

*Attesting Officer*

Q. TODD DICKINSON

*Acting Commissioner of Patents and Trademarks*

US0047367 B1

REEXAMINATION CERTIFICATE ( 93 d)

United States Patent [19]

McMellon

[ ] 4,736,787

[45] Certificate Issue Nov. 16, 1999

[54] LOST FOAM HANDLING SYSTEM

[75] Inventor: Bruce A. McMellon, Birmingham, Ala.

[73] Assignee: Vulcan Engineering Co.

Reexamination Request:
No. 90/005,303, Mar. 24, 1999

Reexamination Certificate for:

| | |
|---|---|
| Patent No.: | **4,736,787** |
| Issued: | **Apr. 12, 1988** |
| Appl. No.: | **07/067,486** |
| Filed: | **Jun. 29, 1987** |

Certificate of Correction issued Apr. 27, 1999.

[51] Int. Cl.[6] ..... B22D 33/00

[52] U.S. Cl. ..... 164/154.1; 164/324; 164/339; 198/793; 198/845

[58] Field of Search ..... 164/154.1, 154.2, 164/34, 130, 322, 323, 324, 325, 326, 150.1, 151.2, 339; 198/793, 795, 800, 838, 845

[56] References Cited

U.S. PATENT DOCUMENTS

| | | | |
|---|---|---|---|
| 818,927 | 4/1906 | Waite . | |
| 1,157,697 | 10/1915 | Kenvin . | |
| 1,343,386 | 6/1920 | Bomberg . | |
| 1,798,485 | 3/1931 | Mulvihill . | |
| 2,154,967 | 4/1939 | Wurster . | |
| 2,347,346 | 4/1944 | Wright | 164/150 |
| 2,601,199 | 6/1952 | Zabel . | |
| 2,612,668 | 10/1952 | Hutchison . | |

(List continued on next page.)

FOREIGN PATENT DOCUMENTS

| | | |
|---|---|---|
| 0 166 228 | 6/1973 | European Pat. Off. . |
| 0112470 | 7/1984 | European Pat. Off. . |
| 2068668 | 8/1971 | France . |
| 1 100 236 | 2/1961 | Germany . |
| 153305 | 3/1921 | United Kingdom . |
| 258621 | 12/1927 | United Kingdom . |
| 331774 | 7/1930 | United Kingdom . |
| 531791 | 1/1941 | United ngdon |
| 734892 | 8/1955 | United ngdon |
| 1 314 591 | 4/1973 | United ngdon |
| 1 335 400 | 10/1973 | United ngdon |
| 1 342 691 | 1/1974 | United ngdon |
| 1 452 255 | 10/1976 | United ngdon |
| 1 495 966 | 12/1977 | United ngdon |
| 1 525 670 | 9/1978 | United ngdon |
| 1 546 499 | 5/1979 | United ngdon |
| 1 584 329 | 2/1981 | United ngdon |
| 2 152 414 | 8/1985 | United ngdon |
| 2152414A | 8/1985 | United ngdon |
| WO81/00976 | 4/1981 | WIPO . |
| WO81/02698 | 10/1981 | WIPO . |

OTHER PUBL ATIC S

Forging Casting, Metals Handbc s, 8th i., vol. 5, 1970, p. 164.

Updating a Foundry Molding C ratio Foundry Application Study, reprinted from Fouc y Tra Journal Information, Mar. 1981, 2p.

Oct. 1983, Dependable Fordath, ic., p luct news release, Iss. 10, vol. 1, pp. 159–160.

Policast brochure by Teksid anc Fata, 34.

Casting Using Polystyrene: Mc Eco mical Than Pressure Die Casting, by D.M. B estea taken from Steel Castings Research & Trade A oc., I ormation Section, Mar., 1985, pp. 1–12.

(List continued o next ge.)

*Primary Examiner*—K. Y. Lin

[57] ABSTRA CT

A conveyor system for use in a lost f n casting system connects a plurality of stations where operations necessary to the process are carried ou The stem utilizes an interconnected train of open fran gon as supported on a set of elevated parallel horizon l rail forming a closed loop. The gondolas each suppor flasl herein molds are placed and sand molds are comp ted, h the flasks being removable from the gondolas as ecess for the particular operation. A programmable con oller ses the status of the system and provides signals oper the conveyor and associated components.

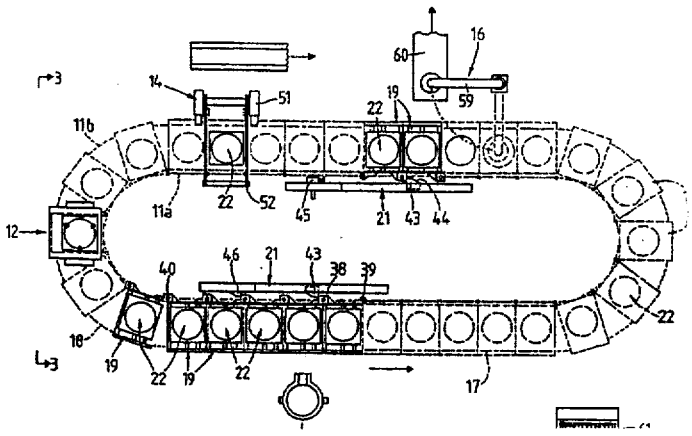

U.S. PATENT DOCUMENTS

| | | | |
|---|---|---|---|
| 2,752,646 | 7/1956 | Lasater . | |
| 2,767,865 | 10/1956 | Lasater et al. . | |
| 2,830,343 | 4/1958 | Shroyer . | |
| 3,068,537 | 12/1962 | Fellows . | |
| 3,083,421 | 4/1963 | Taccone . | |
| 3,123,871 | 3/1964 | Taccone . | |
| 3,343,591 | 9/1967 | Lorang . | |
| 3,476,231 | 11/1969 | Bower . | |
| 3,512,576 | 5/1970 | Plume et al. . | |
| 3,565,239 | 2/1971 | Walker et al. | 198/845 |
| 3,581,802 | 6/1971 | Krzyzanowski . | |
| 3,620,286 | 11/1971 | Hofmann . | |
| 3,655,031 | 4/1972 | Cahn . | |
| 3,695,338 | 10/1972 | Masi . | |
| 3,703,921 | 11/1972 | Hunter . | |
| 3,741,281 | 6/1973 | Hauser-Lienhard . | |
| 3,767,168 | 10/1973 | Dupre' et al. . | |
| 3,840,063 | 10/1974 | Staley . | |
| 3,868,986 | 3/1975 | Olsen . | |
| 3,955,613 | 5/1976 | Lund . | |
| 3,977,461 | 8/1976 | Pol et al. . | |
| 4,149,620 | 4/1979 | Rosensweig . | |
| 4,227,565 | 10/1980 | Lavanchy et al. . | |
| 4,261,413 | 4/1981 | Blower et al. . | |
| 4,275,783 | 6/1981 | Geiger . | |
| 4,299,269 | 11/1981 | Friesen et al. | 164/324 |
| 4,371,075 | 2/1983 | Erlichman . | |
| 4,402,393 | 9/1983 | Kent | 198/803.01 |
| 4,454,906 | 6/1984 | Musschoot . | |
| 4,492,301 | 1/1985 | Inaba et al. . | |
| 4,509,578 | 4/1985 | Shaw . | |
| 4,593,739 | 6/1986 | VanRens et al. . | |
| 4,674,620 | 6/1987 | Inoue . | |
| 4,778,045 | 10/1988 | Grune et al. . | |

OTHER PUBLICATIONS

Developing Equipment for Policast Lost Foam Molding, EPC Technology, by C.A. Goria, M. Remondino & M. Selli from Foundry Trade Journal, pp. 191–196, Sep. 12, 1985.

General Kinematics ad, 1985, 2 p., taken from Evaporative Foam casting Technology II Program, Nov. 12–13, 1986, Rosemont, IL.

General Kinematics Corp. article, pp. 186–193, taken from Evaporative Foam Casting Technology II Program, Nov. 12–13, 1986, Rosemont, IL.

C.E. Cast Equipment Combustion Engineering, Inc., Lost Foam Casting Systems, 4 p., 1984, taken from Evaporative Foam Casting Technology II Program, Nov. 11–12, 1986, Rosemont, IL.

Molding of Iron Castings with Evaporative Polystyrene Foam Patterns Immersed in Loose Sand: Prospects and Problems by C.A. Goria and G. del Gaudio, Tecksid SPA, Divisione Founderie Ghisa–CASTEK: G. Caironi and G. Silva, Dipartimento di Chimica–Fiscia Applicata, Politecnico di Milano; M. Selli; Fata European Group, SPA, pp. 31–1 through 31–18.

Amended Opinion in Vulcan Engineering Co., Inc. v. Fata Aluminum, Inc., (U.S. District Court for the Eastern District of Michigan, Southern Division; Civil Action No. CV–98–74495).

New Techniques and Unique A omati are Keys to Lost Foam System Success, Foundr M&T ec. 1983, ©1983, Roberts Corporation.

Dependable Foundry Equipm : Co any, Inc., Multi–Axial Compaction Table Ancl s Ou ine of New EPC (Foam Pattern) Process Equipm it, Pr ict News Release, Oct. 1983.

John Deere, Specifications for L t Foa Molding Unit and Sand System, Feb., 1986, East oline linois.

C.E. Cast Equipment, Lost Fo n Ca g System, 1984, Cleveland, Ohio.

Robert Mrdjenovich, EPC at F d, M m Casting, Feb., 1984, pp. 235–241.

James F. Foster, How To Maste Lost I m Casting In Six Easy Steps, Roberts Corporation ublic n, 1985, Lansing, Michigan.

"Typical Lost Foam Arrangem it" C Cast Equipment Advertisement, Modern Metals ublic n, 1983.

Alfredo Dalpan, Supplemental clara n of Alfredo Dal-Pan, Jul. 9, 1999.

V.H. Burchell, "Production Sy ms f Lost–Foam Casting", Transactions of the Ameri n Fo irymen's Society, 1984, p. 629, vol. 92.

General Kinematics, "Compac n tal that make new molding techniques work better d fas" brochure, 1985.

W.C. Suttles, untitled, Oct. 1 1985 vaporative Foam Casting Technology Conferenc pp. 1–166, Jervis B. Webb Co.

Barry, Peter "Cavityless Castin of M ls and Method of Making Same" product informa n bul in, Oct. 10, 1985, pp. 1–13, Thiem Corporation.

Patz, Murray "The Implementat n of sign, Engineering and Productivity in Successful apor e Foam Casting" Oct. 10, 1985, pp. 95–101, Los Foam chnologies.

Baker, Bryan "Evaporative I tern sting Seminar", Evaporative Foam Casting Tec olog I Program, Nov. 1986 (individual drawings publ ed 1 –1985).

Planet Corporation "Let Planet ovide ou With the Benefits of Evaporative Pattern Cas g Sy ms", Evaporative Foam Casting Technology II Pr am, I v. 1986 (brochure believed published earlier, c. 19 –198

Planet Corporation "Accum–A- uc, I et's Revolutionary Automated Accumulating H dling ystem", Evaporative Foam Casting Technology I Progr , Nov. 1986 (brochure believed published earlier c. 198

Modern Casting "Foundry Con derati s", Apr. 1982, p. 60.

General Kinematics Corp. "Ger al Ar gement of Three (3) 30" Diameter×36" Deep Sp al E. Flasks for Fredonia Foundry, Inc., Fredon Wi , Drawing No. C5484–3–1, Jun. 1985.

FATA Industrial, "Systems And achin For The Production Of Castings Using Expe lable odels Made Of Expanded Polystyrene," paper p sente Italian National Foundry Association Sep. 27– , 198 (Italian original, English translation and explan ry d aration of FATA officer Dal Pan).

REEXAMINATION CERTIFICATE ISSUED UNDER 35 U.S.C. 307

NO AMENDMENTS HAVE BEEN MADE TO THE PATENT

AS A RESULT OF REEXAM IATI( , IT HAS BEEN DETERMINED THAT:

The patentability of claims 1 .9 is ıfirmed.

* * * *